US007737364B2

(12) United States Patent
Park et al.

(10) Patent No.: US 7,737,364 B2
(45) Date of Patent: Jun. 15, 2010

(54) FLAME RETARDANT COMPOSITION FOR CABLE COVERING MATERIAL AND OCEAN CABLE USING THE SAME

(75) Inventors: Do-Hyun Park, Anyang-si (KR); Il-Gun Seo, Anyang-si (KR)

(73) Assignee: LS Cable Ltd. (KR)

( * ) Notice: Subject to any disclaimer, the term of this patent is extended or adjusted under 35 U.S.C. 154(b) by 33 days.

(21) Appl. No.: 11/994,047

(22) PCT Filed: Jul. 7, 2005

(86) PCT No.: PCT/KR2005/002188

§ 371 (c)(1),
(2), (4) Date: Jun. 25, 2008

(87) PCT Pub. No.: WO2007/004760

PCT Pub. Date: Jan. 11, 2007

(65) Prior Publication Data

US 2009/0090536 A1 Apr. 9, 2009

(30) Foreign Application Priority Data

Jul. 1, 2005 (KR) ..... 10-2005-0059113

(51) Int. Cl.
*H01B 3/00* (2006.01)

(52) U.S. Cl. ..... 174/121 A

(58) Field of Classification Search ..... 174/110 R, 174/110 SR, 120 R, 121 A
See application file for complete search history.

(56) References Cited

U.S. PATENT DOCUMENTS

| | | | | |
|---|---|---|---|---|
| 4,500,748 | A | 2/1985 | Klein | |
| 4,549,041 | A | 10/1985 | Shingo et al. | |
| 4,869,848 | A | 9/1989 | Hasegawa et al. | |
| 5,358,786 | A | 10/1994 | Ishikawa et al. | |
| 6,500,882 | B1 | 12/2002 | Hiraishi et al. | |
| 2006/0255501 | A1 * | 11/2006 | Jackson et al. | 264/236 |

FOREIGN PATENT DOCUMENTS

| | | | |
|---|---|---|---|
| JP | 2-145855 | A | 6/1990 |
| JP | 3-254016 | A | 11/1991 |

OTHER PUBLICATIONS

International Search Report, dated Mar. 24, 2006, issued in International Application No. PCT/KR2005/002188.

* cited by examiner

*Primary Examiner*—Chau N Nguyen
(74) *Attorney, Agent, or Firm*—NSIP Law

(57) ABSTRACT

Disclosed are a flame retardant composition for a cable covering material and an ocean cable using the same. The flame retardant composition of the present invention includes 100 parts by weight of a base resin; 30~150 parts by weight of a flame retardant; 1-30 parts by weight of a cold resistant plasticizer; 0.5~10 parts by weight of a silane coupling agent; 0.5-8 parts by weight of a co-crosslinking agent; and 3-20 parts by weight of a crosslinking agent, and the ocean cable using the same. The composition for a cable covering material according to present invention has an excellent oil resistance to oil components without deteriorating mechanical properties, and has a superior durability such as a cold resistance at −40° C. as well as minimally generates toxic gases upon firing and has an excellent flame retardancy.

18 Claims, 1 Drawing Sheet

[Fig. 1]
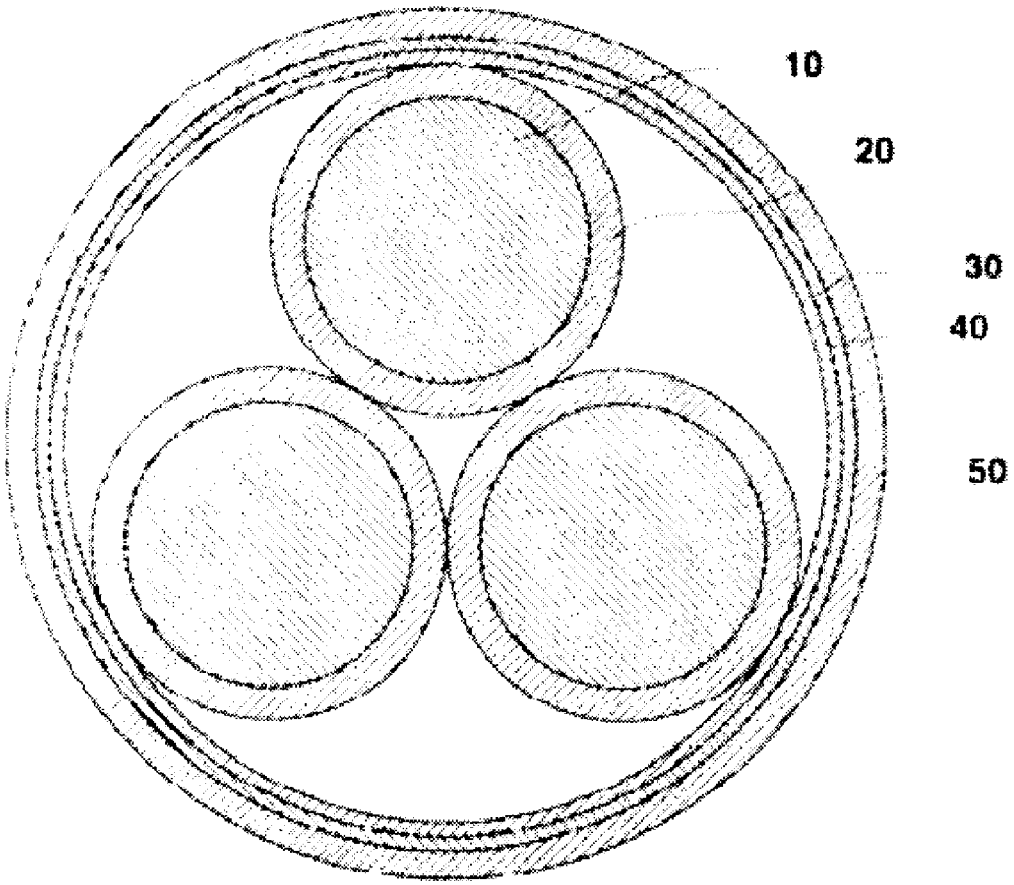

FLAME RETARDANT COMPOSITION FOR CABLE COVERING MATERIAL AND OCEAN CABLE USING THE SAME

CROSS-REFERENCE TO RELATED APPLICATIONS

This application is a is a national stage application under 35 U.S.C. 371 based on and claiming the benefit of International Application Serial No. PCT/KR2005/002188 filed on Jul. 7, 2005 and the benefit of priority from Korean Application No. 10-2005-59113 filed on Jul. 1, 2005, the entire contents of each of which is incorporated herein by reference.

TECHNICAL FIELD

The present invention relates to a flame retardant composition for a cable covering material and an ocean cable using the same, and more particularly to a flame retardant composition for a cable covering material including a predetermined base resin as well as predetermined components such as a flame retardant, a cold resistant plasticizer, a silane coupling agent, a co-crosslinking agent and a crosslinking agent so as to exhibit an excellent physical properties such as oil resistance, cold resistance and durability while maintaining mechanical properties, and minimize emission of toxic gases upon firing and exhibit an excellent flame retardancy, and an ocean cable using the same.

BACKGROUND ART

Cables, used for shipping crafts and offshore structures at an early stage, was used without any difficulty if they have predetermined levels of flexibility and durability in combination with electrical properties in use environments. However, many offshore structures have been installed for oil well drilling as an amount of used crude petroleum increases in recent years. Such offshore structures were installed mainly in the sea near the coast, but have been located in the see remote from hot regions such as Africa in recent years. Also, structures have been generally installed in isolated severe cold regions, for example the structures have been installed and operated in very low temperature regions such as near coastal regions of Siberia, Russia.

The cables used in such severe environments should essentially have suitable characteristics for the use environments, and standard requirements according to the conventional standards have been reinforced as uses of the cables increase in the severe environments. For example, there was required a cable having a cold resistance at −15~−30° C. in prior art, but there has been required a cable having a cold resistance at a temperature of −40° C. or below in recent years in order to meet specific test standards. In addition, there have been many difficult attempts to develop materials and cables that meet desired characteristics including specific standards in addition to the conventional standards.

In recent years, since the offshore structures are installed and operated in the isolated severe cold regions as described above, the offshore structures should be equipped with means capable of solving problems by themselves in an emergency, particularly when a fire breaks out. Accordingly, there has been required a cable having a high flame retardancy, which has been used for the offshore structures in recent years, in order to ensure stability of the cable on firing.

Also, conventional flame-retardant cables may satisfy other desired characteristics and easily ensure flame retardancy by using various rubbers and polymeric resins containing halogen as a halogen content of the cables is regulated to 18% or less. For example, the halogen-containing rubbers such as polychloroprene or chlorosulfonated polyethylene have been used to develop suitable materials and cables for their special purposes. However, these halogen components emit many toxic gases on firing, which cause a loss of lives, as well as do damage to enormous properties, for example corroding expensive equipments used in the offshore structures. In recent years, there have, therefore, been increasing attempts to develop a technique for inhibiting emission of corrosive gases, particularly halogen gas during the combustion by basically regulating a halogen content to 5% or less according to IEC754-1. In addition, the halogen-containing materials are deteriorated in an oil resistance against specific oils such as gasoline or oil containing aliphatic compounds as a main component, and therefore there is a limit to their uses.

There have been attempts to solve basic problems on the halogen content in the prior art by employing non-halogen materials, but the non-halogen materials may not be used for specific applications since they are so expensive and it is difficult to meet desired characteristics except for the basic standards.

The oil resistance of an ocean cable was required to just satisfy durability against specific gasoline components or general water based muds in the prior art, but wide long-term durabilities against specific water based muds such as ester based mud, oil based mud, cement slurry, synthetic oil based mud and the like have been required in recent years.

As described above, there have been attempts to develop a cable that satisfies various standards by developing novel materials that satisfy oil resistance, cold resistance, low toxicity and flame retardancy together. However, there have been many technical limits that a cable meets low toxicity and cold resistance in addition to the basic properties such as oil resistance and flame retardancy, etc., and particularly it was increasingly difficult to ensure a cable covering material that satisfies a cold resistance at −40° C. or below, an oxygen index of 30 or more and IEC 60332-3 Cat.A for flame retardancy together due to conflicting properties of the flame retardancy and the cold resistance.

DISCLOSURE OF INVENTION

Technical Problem

Accordingly, the present invention is designed to solve the problems of the prior art, and therefore it is an object of the present invention to provide a flame retardant composition for a cable covering material that has an excellent oil resistance against oil components and a superior durability, for example cold resistance at −40° C. according to CSA C 22.2 NO. 38, as well as minimally generates toxic gases upon firing and has an excellent flame retardancy.

Technical Solution

In order to accomplish the above object, the present invention provides a flame retardant composition for a cable covering material including 100 parts by weight of a base resin including 5~80 parts by weight of chlorosulfonated polyethylene and 30~90 parts by weight of an ethylene/vinyl acetate copolymer having a vinyl acetate content of 28~80% by weight; 30~150 parts by weight of metal oxide as a flame retardant; 1~30 parts by weight of a cold resistant plasticizer; 0.5~10 parts by weight of a silane coupling agent; 0.5~8 parts by weight of a co-crosslinking agent; and 3~20 parts by weight of a crosslinking agent.

At this time, the base resin is preferably grafted with polar groups and further includes 1 to 15 parts by weight of a modified ethylene/vinyl acetate copolymer having a vinyl acetate content of 28 to 50% by weight. Here, a content of the polar groups is more preferably 0.5 to 2.0% by weight, based on the total weight of the modified ethylene/vinyl acetate copolymer, and the polar groups may be one selected from the group consisting of maleic anhydride, glycidyl methacrylate and acrylic acid.

In the present invention, the metal oxide is also at least one selected from the group consisting of aluminum hydroxide, magnesium hydroxide, calcium hydroxide, basic magnesium carbonate, hydrotalcite, huntite and hydromagnesite, and they may be used alone or combination thereof.

Also, the cold resistant plasticizer is one selected from the group consisting of di-2-ethylhexyladipate, di-2-ethylhexylazelate, di-2-ethylhexylsebacate and diisodecyl adipate, and they may be used alone or combination thereof.

In addition, the composition for a cable covering material of the present invention may further includes 2 to 30 parts by weight of a metal complex, based on 100 parts by weight of the base resin, wherein the metal complex is at least one selected from the group consisting of antimony trioxide, molybdenum-phosphated zinc oxide, ammonium octa-molybdate, zinc-based molybdenum complex, zinc:calcium-based molybdenum complex, an inorganic additive in which magnesium oxide and silica are added to zinc-based molybdenum, an inorganic additive in which zinc oxide is mixed with phosphated zinc oxide, a boron compound and hydrotalcite, and they may be used alone or combination thereof.

The flame retardant composition for a cable covering material according to the present invention preferably satisfies an oxygen index of 30% or more, a tensile strength of 1.05 $kgf/mm^2$ or more, an elongation of 250% or more and a halogen content of 5% or less.

Meanwhile, in order to accomplish the above object, the present invention provides an ocean cable including a conductor; an insulating layer surrounding the conductor; a bedding layer surrounding the insulating layer; a braided layer surrounding the bedding layer; and a sheath layer surrounding the braided layer. At this time, at least one of the bedding layer and the sheath layer is preferably made of the flame retardant composition for a cable covering material according to the present invention, as described above.

BRIEF DESCRIPTION OF THE DRAWINGS

FIG. 1 is a cross-sectional view showing an ocean cable according to the present invention.

BEST MODE FOR CARRYING OUT THE INVENTION

Hereinafter, preferred embodiments of the present invention will be described in detail with reference to the accompanying drawings.

In the composition for a covering material according to the present invention, a mixed resin including chlorosulfonated polyethylene and an ethylene vinyl acetate copolymer having a vinyl acetate content of 28~80% by weight is used as a base resin.

Here, the base resin has a chlorosulfonated polyethylene content of 5~80 parts by weight. This is because inherent characteristics, for example heat resistance, weather resistance, oil resistance, chemical resistance and the like, of the chlorosulfonated polyethylene are deteriorated if a content of the chlorosulfonated polyethylene resin is less than 5 parts by weight. On the while, if a content of the chlorosulfonated polyethylene resin exceeds 80 parts by weight, it is difficult to ensure an oil resistance against oil components of the composition, and additional specific additives should be added to reduce generation of toxic gases on firing due to an excessive halogen content, and therefore it is uneconomic and physical properties of the cable are also deteriorated.

Also, the ethylene/vinyl acetate copolymer has a vinyl acetate content of 28~80% by weight in the present invention. If the vinyl acetate content is less than 28% by weight, a covering layer formed thereof is deteriorated in an oil resistance against aliphatic compound-based oils, and therefore the oils are precipitated, which causes severe expansion of the covering layer and striking deterioration of residual tensile strength and residual elongation. In addition, the ethylene/vinyl acetate copolymer may not be mixed with the above-mentioned polar rubber, chlorosulfonated polyethylene, since it is poorly compatible to the chlorosulfonated polyethylene. On the while, if the vinyl acetate content exceeds 80% by weight, a flame retardancy and a tensile strength out of the mechanical properties are deteriorated due to a low content of the chlorosulfonated polyethylene.

Also, a content of the ethylene/vinyl acetate copolymer ranges from 30 to 90 parts by weight. This is because it is not possible to ensure an oil resistance against ester-based oils and a flame retardancy is rarely improved if a content of the ethylene/vinyl acetate copolymer is less than 30 parts by weight, while a cold resistance is significantly deteriorated and a tensile strength is reduced if the content exceeds 90 parts by weight.

Additionally, the above-mentioned base resin has a vinyl acetate content of 28~50% by weight and may further include a modified ethylene/vinyl acetate copolymer grafted with polar groups. Here, an example of the polar groups includes, but is not limited to, maleic anhydride, glycidyl methacrylate, acrylic acid, etc. Also, a content of the polar groups preferably ranges from approximately 0.5 to 2% by weight. The modified ethylene/vinyl acetate copolymer grafted with the polar groups functions to improve mechanical properties and thermal properties of the composition according to the present invention. In this aspect, the content of the modified ethylene/vinyl acetate copolymer is preferably included at a content of 1~15 parts by weight of the base resin. This is because the modified ethylene/vinyl acetate copolymer has a low synergic effect of a tensile strength due to its rare role as a polymeric reinforcing material if a content of the modified ethylene/vinyl acetate copolymer is less than 1 part by weight, while physical properties such as elongation, extrudability, oil resistance and the like are deteriorated if the content exceeds 15 parts by weight.

The composition according to the present invention includes 30~150 parts by weight of metal oxide as a flame retardant, based on 100 parts by weight of the above-mentioned base resin. This is because it is not possible to ensure a sufficient flame retardancy and a sufficient solidification of a carbonizing layer and it is difficult to obtain a neutralization effect of a halogen gas during the combustion if a content of the metal oxide is less than 30 parts by weight. On the while, an elongation, a cold resistance, extrudability and the like are strikingly deteriorated if the content exceeds 150 parts by weight. The metal oxide is not particularly limited if it may be used as the cable covering material, and an example of the metal oxide is selected from the group consisting of, but not limited to, aluminum hydroxide, magnesium hydroxide, calcium hydroxide, basic magnesium carbonate, hydrotalcite, huntite, hydromagnesite, etc., and they may be used alone or in combination thereof. The untreated metal oxide may be used, but the metal oxide surface-treated with fatty acid, polymeric resin, silane compounds or the like may be used in consideration of physical properties of the composition according to the present invention.

In order to ensure a cold resistance such as resistance properties against low temperature impact and bending at −40° C. or below according to CSA C 22.2 NO. 38, the composition of the present invention includes 1 to 30 parts by weight of a cold resistant plasticizer, based on 100 parts by weight of the base resin. This is because a cold resistance is rarely improved if a content of the cold resistant plasticizer is less than 1 part by weight, while a cold resistance may be ensured if the content exceeds 30 parts by weight, but a flame retardancy is deteriorated if the composition includes a large amount of organic materials, that is, it is not possible to ensure a flame retardancy having an oxygen index of 30 or more, and a tensile strength is also deteriorated since a plasticizing effect is maximized. In this case, extrudates of the flame retardant materials are also easily deformed by external stresses due to a low extrudate hardness, and a residual elongation is low due to deteriorated thermal properties.

An example of the cold resistant plasticizer which may be used in the present invention includes cold resistant plasticizers of fatty acid (dibasic) esters selected from the group consisting of, but is not limited to, di-2-ethylhexyladipate, di-2-ethylhexylazelate, di-2-ethylhexylsebacate, diisodecyl adipate, etc., and they may be used alone or in combination thereof.

Also, the composition of the present invention includes 0.5 to 10 parts by weight of a silane coupling agent, based on 100 parts by weight of the base resin. This is because a tensile strength and a heat resistant property are rarely improved if a content of the silane coupling agent is less than 0.5 parts by weight, while an elongation and a flame retardancy are deteriorated if the content exceeds 10 parts by weight. The preferred silane coupling agent includes vinyltrimethoxyethoxysilane, oligomeric vinyltrimethoxysilane, vinyltriethoxysilane, etc., and they may be used alone or in combination thereof. In addition, other materials pertaining to equivalent technical scopes may be used herein, as apparent to those skilled in the art.

The composition of the present invention includes 3 to 15 parts by weight of a crosslinking agent, based on 100 parts by weight of the base resin. This is because a tensile strength, a gasoline resistance and a heat resistant property are not satisfied and extrudates of the flame retardant materials are easily deformed by pressing at a high temperature if a content of the crosslinking agent is less than 3 parts by weight. On the while, an elongation is lowered if the content exceeds 15 parts by weight. A preferred example of the crosslinking agent includes, but is not limited to, 1,1-bis(tert-butylperoxy)-3,3,5-trimethylcyclohexane, di-(2,4-dichlorobenzoyl)-peroxide, dibenzoyl peroxide, tert-butyl peroxybenzoate, 1,1-di-(tert-butylperoxy)-3,3,5-trimethylcyclohexane, dicumyl peroxide, di-(2-tert-buty-peroxyisopropyl)-benzene, tert-butylcumylperoxide, 2,5-dimethyl-2,5-di-(tert-butylperoxy)-hexane, di-tert-butylperoxide, 2,5-dimethyl-2,5-di(tert-butylperoxy)hexyme-3, etc., and they may be used alone or in combination thereof.

The composition of the present invention includes 0.5 to 8 parts by weight of a co-crosslinking agent, based on 100 parts by weight of the base resin. This is because an oil resistance, a tensile strength and a flame retardancy are deteriorated if a content of the co-crosslinking agent is less than 0.5 parts by weight, while an elongation is abruptly lowered if the content exceeds 8 parts by weight. A preferred example of the co-crosslinking agent includes, but is not limited to, triaryl cyanurate, triaryl isocyanurate, etc., and they may be used alone or in combination thereof.

In addition, the composition of the present invention preferably further includes a metal complex. The metal complex effectively inhibits emission of halogen gas by reacting with halogen elements or compounds containing the halogen elements during the combustion. An example of the metal complex, which may be used in the present invention, includes, but is not limited to, antimony trioxide, molybdenum-phosphated zinc oxide, ammonium octa-molybdate, zinc-based molybdenum complex, zinc:calcium-based molybdenum complex, an inorganic additive in which magnesium oxide and silica are added to zinc-based molybdenum, an inorganic additive in which zinc oxide is mixed with phosphated zinc oxide, a boron compound and hydrotalcite, and they may be used alone or combination thereof. At this time, the hydrotalcite should be added in a large amount if it is used as metal hydroxide, but may be added in a small amount if it is used as a metal complex.

The composition of the present invention preferably includes approximately 2 to 50 parts by weight of the metal complex, based on 100 parts by weight of the base resin. This is because a flame retardant effect is rarely improved, for example the metal complex does not effectively inhibit emission of halogen gas due to its low reactivity with halogen if a content of the metal complex is less than 2 parts by weight, while the composition is deteriorated in physical properties such as dispersibility, mechanical properties, heat resistant property, cold resistance and the like due to an effect of inorganic additives having a large particle size if the content exceeds 50 parts by weight.

Also, the composition of the present invention may further include 1 to 50 parts by weight of an auxiliary flame retardant having an excellent effect by itself as well as an excellent reinforcing effect, based on 100 parts by weight of the base resin. This is because a tensile strength is rarely improved and charr is slightly formed due to a low reinforcing effect of the auxiliary flame retardant if the content of the auxiliary flame retardant is less than 1 parts by weight, while a flame retardancy is improved due to the formation of the solidified charr during the combustion, but an elongation may be abruptly lowered and an extrudability may be deteriorated due to an increased viscosity if the content exceeds 50 parts by weight. Silica such as ground silica, precipitated silica, fumed silica and the like, talc, clay, etc. may be used as the auxiliary flame retardant, but the present invention is not limited thereto.

Also, the composition of the present invention preferably includes a clay having a nano-particle size (nanoclay). In order to improve an oil resistance, a heat resistant property, an effect on solidification of charr during the combustion, etc., the composition of the present invention may include 1 to 30 parts by weight of the clay having a nano-particle size, based on 100 parts by weight of the base resin. This is because gas and oil transmissivity peculiar to the clay is deteriorated and the charr is rarely solidified if a content of the nanoclay is less than 1 parts by weight, while a flame retardancy is not significantly enhanced if the content exceeds 30 parts by weight.

In addition, the composition of the present invention may include, but is not limited to, additives such as an antioxidant, a lubricant, a scorch retarder, a crosslinking accelerator, anti-aging agent, au ultraviolet stabilizer, sulfur, etc., without departing from the spirit and scope of the invention.

The composition for a covering material of the present invention has an oxygen index of 30 or more, a tensile strength of 1.05 kgf/mm$^2$ or more, an elongation of 250% or more and a halogen content of 5% or less, and has an excellent long-term oil resistance and cold resistance as well as a low toxicity and an excellent flame retardancy.

FIG. 1 is a cross-sectional view showing an ocean cable according to the present invention.

The above-mentioned composition for a covering material of the present invention may be applied to a covering layer, such as a bedding body and a sheath body, of a conventional ocean cable, as shown in FIG. 1. That is, referring to FIG. 1, the ocean cable generally includes a conductor 10, an insulating layer 20 surrounding the conductor, a bedding layer 30 surrounding the insulating layer 20, a braided layer 40 surrounding the bedding layer 30 and a sheath layer 50 surrounding the braided layer 40, wherein the above-mentioned composition for a covering material may be applied to any one or both of the bedding body and the sheath body. However, a use of the above-mentioned composition for a covering material is not limited to the ocean cable, and therefore the composition for a covering material may be effectively used as a covering material of various electric wires and cables.

The ocean cable satisfies a CSA cold resistance at −40° C. and an IEC 60332-3 Cat.A for flame retardancy. The physical properties of the covering material may be minimally changed in the cable even though an aliphatic compound cycloparaffinic hydrocarbon is exposed for an extended period to a fluid used in an offshore drilling process as a major component.

MODE FOR THE INVENTION

Hereinafter, preferred embodiments of the present invention will be described in detail referring to the accompanying drawings. However, the description proposed herein is just a preferable example for the purpose of illustrations only, not intended to limit the scope of the invention, so it should be understood that other equivalents and modifications could be made thereto without departing from the spirit and scope of the invention. Preferred embodiments of the present invention will be provided to those skilled in the art for the purpose of more full description of the present invention.

EMBODIMENTS 1 AND 6 AND COMPARATIVE EXAMPLES 1 AND 5

Components of the cable covering material were prepared according to compositions and contents as listed in the following Tables 1 and 2. Then, each of the components was mixed in an open roller, and the resultant mixtures were molded at 170° C. for 20 minutes using a press to obtain test specimens. Also, cables having a covering layer made of each of the compositions were manufactured. Units in Tables 1 and 2 are parts by weight.

TABLE 1

| | Embodiments | | | | | |
|---|---|---|---|---|---|---|
| | 1 | 2 | 3 | 4 | 5 | 6 |
| Chlorosulfonated polyethylene | 30 | 20 | 30 | 20 | 10 | 20 |
| Ethylene/vinyl acetate copolymer (Vinyl acetate content: 70% by weight) | 70 | 70 | 70 | | | |
| Ethylene/vinyl acetate copolymer (Vinyl acetate content: 40% by weight) | | | | 80 | 80 | 80 |
| Maleic anhydride-grafted modified ethylene/vinyl acetate copolymer | | 10 | | | 10 | |
| Antioxidant | 3 | 3 | 3 | 3 | 3 | 3 |

TABLE 1-continued

| | Embodiments | | | | | |
|---|---|---|---|---|---|---|
| | 1 | 2 | 3 | 4 | 5 | 6 |
| Clay | | | | 50 | 50 | 50 |
| Magnesium hydroxide | 90 | 100 | 100 | 90 | 100 | 100 |
| Metal complex | 50 | 50 | 50 | | | |
| di-2-ethylhexyladipate | 15 | 15 | 15 | 15 | 15 | 15 |
| Silane | 2 | 2 | 2 | 2 | 2 | 2 |
| Co-crosslinking agent | 3 | 3 | 3 | 3 | 3 | 3 |
| Crosslinking agent | 9 | 9 | 9 | 9 | 9 | 9 |
| Nanoclay | 10 | | | 10 | | |

In the Table 1, LEVAPREN 700HV (Bayer) was used as the ethylene/vinyl acetate copolymer having a vinyl acetate content of 70% by weight; EVAFLEX 40LX (Dupont-Mitsui) was used as the ethylene/vinyl acetate copolymer having a vinyl acetate content of 40% by weight; an ethylene/vinyl acetate copolymer grafted with 0.2 to 5% by weight of maleic anhydride was used as the modified ethylene/vinyl acetate copolymer grafted with maleic anhydride; IRGANOX 1010 (Giba-Geigy) was used as the antioxidant; Clay SP33 (ENGELHARD) was used as the clay; Magnifin H5 (Albermarle) was used as the magnesium hydroxide; ZB2335 (Borax) was used as the metal complex; DOA (LG Chemicals) was used as the di-2-ethylhexyladipate; A-172 (UCC) was used as the silane; TAIC M70 (LG Chemicals) was used as the co-crosslinking agent; PERKADOX 14/40 PD (AKZO) was used as the crosslinking agent; and SE3000 (SUD CHEMI) was used as the nanoclay.

TABLE 2

| | Comparative examples | | | | |
|---|---|---|---|---|---|
| | 1 | 2 | 3 | 4 | 5 |
| Chlorosulfonated polyethylene | 100 | 100 | | | |
| Chlorosulfonated polyethylene | | | 100 | | |
| Ethylene/vinyl acetate copolymer (Vinyl acetate content: 70% by weight) | | | | 100 | 100 |
| Zinc oxide | 5 | 5 | 5 | | |
| Magnesium oxide | 4 | 4 | | | |
| Anti-aging agent | | | 2 | | |
| Antioxidant | | | | 2 | 2 |
| Processed oil | 20 | 15 | 5 | | |
| Plasticizer | | 10 | | | 10 |
| Clay | 20 | 20 | | | |
| Carbon black | 30 | 30 | | 5 | 5 |
| Antimony trioxide | 10 | 10 | 10 | | |
| Magnesium hydroxide | 20 | 30 | 60 | 100 | 100 |
| Crosslinking accelerator | 2 | 2 | | | |
| Crosslinking agent | | | 6 | 6 | 6 |

In the Table 2, Neoprene W (Dupont) was used as the polychloroprene rubber; Hypalon 40 (Dupont) was used as the chlorosulfonated polyethylene; LEVAPREN 700HV (Bayer) was used as the ethylene/vinyl acetate copolymer having a vinyl acetate content of 70% by weight; ZnO (KS No. 2, Hanil Chemical IND. Co., Ltd.) was used as the zinc oxide; MgO (HYEOP HWA Co., Ltd) was used as the magnesium oxide; Kumanox RD (KUMHO MONSANTO, INC.) was used as the anti-aging agent; IRGANOX 1010 (Giba-Geigy) was used as the antioxidant; PS-32 (S-oil) was used as the processed oil; DIDP (LG Chemicals) was used as the plasticizer; Clay SP33 (ENGELHARD) was used as the clay; FEF (Hankuk Carbon Co., Ltd.) was used as the carbon black; Sb203 (ILYANG CHEMICAL CO., LTD) was used as the antimony trioxide; Kisuma 5B (Kyowa Chemical Industry.

Co. Ltd) was used as the magnesium hydroxide; Oricel DM (DC Chemical Co., Ltd.) was used as the crosslinking accelerator; and DCP (NOF) was used as the crosslinking agent.

The above-mentioned test specimens and cables were measured for physical properties such as room temperature properties, a heat resistance, an oil resistance, a CSA cold resistance, an oxygen index, a halogen content, a flame retardancy and the like, as follows.

1) Room temperature properties: a tensile strength and an elongation were measured at a tensile rate of 250 mm/min according to IEC 60811-1-1.

2) Heat resistance: a test specimen was kept at 100° C. for 168 hours, and then a residual tensile strength and a residual elongation were measured according to IEC 60811-1-1.

3) Oil resistance: Cables are precipitated in the aliphatic compound cycloparaffinic hydrocarbon at 70° C. for 56 days, and then the test specimens are taken out and measured for a residual tensile strength and a residual elongation of the sheath body, and weight and volume change ratios according to the method for measuring the room temperature properties.

4) CSA cold resistance: Cables were measured at −40° C. for impact and bending tests according to CSA C 22.2 NO. 38.

5) Oxygen index: test specimens were measured for a flame retardancy according to ASTM D 2863, and their oxygen indexes should be 30 or more.

6) Halogen content: A halogen content was measured according to IEC 60754-1, and a halogen content of 5% or less should be satisfied.

7) Flame retardancy: Cables were tested according to a standard IEC 60332-3 cat.A for flame retardancy, and heated at a heat capacity of 70,000 Btu/hr for 40 minutes. After the combustion, a combustion length of the cables should be 2.44 m or less.

The measurement results of the test specimens and the cables for physical properties are listed in the following Tables 3 and 4, respectively.

TABLE 3

| | | Comparative examples | | | | | |
|---|---|---|---|---|---|---|---|
| | | 1 | 2 | 3 | 4 | 5 | 6 |
| Room Temperature Properties | Tensile Strength (kgf/mm$^2$) | 1.2 | 1.24 | 1.18 | 1.27 | 1.31 | 1.3 |
| | Elongation (%) | 338 | 346 | 353 | 373 | 352 | 341 |
| Heat Resistance | Residual Tensile Strength (%) | 97 | 98 | 98 | 97 | 103 | 101 |
| | Residual Elongation (%) | 86 | 89 | 94 | 98 | 95 | 91 |
| Oil Resistance | Residual Tensile Strength (%) | 87 | 89 | 86 | 90 | 86 | 91 |
| | Residual Elongation (%) | 82 | 87 | 84 | 85 | 82 | 84 |
| | Weight Change Ratio (%) | 11 | 10 | 10 | 9 | 10 | 9 |
| | Volume Change Ratio (%) | 13 | 14 | 12 | 13 | 12 | 11 |
| CSA Cold Resistance | | Passed | Passed | Passed | Passed | Passed | Passed |
| Oxygen Index | | 31 | 32 | 31 | 32.5 | 31.5 | 33 |
| Halogen Content (%) | | 3.2 | 2.8 | 3.1 | 2.9 | 2.8 | 3.0 |
| Flame Retardancy (M) | | 1.3 | 1.2 | 1.2 | 1.3 | 1.1 | 1.4 |

TABLE 4

| | | Comparative examples | | | | |
|---|---|---|---|---|---|---|
| | | 1 | 2 | 3 | 4 | 5 |
| Room Temperature Properties | Tensile Strength (kgf/mm$^2$) | 1.5 | 1.45 | 1.2 | 0.75 | 0.64 |
| | Elongation (%) | 354 | 381 | 345 | 374 | 420 |
| Heat Resistance | Residual Tensile Strength (%) | 87 | 89 | 84 | 103 | 92 |
| | Residual Elongation (%) | 85 | 83 | 81 | 94 | 89 |
| Oil Resistance | Residual Tensile Strength (%) | 90 | 86 | 96 | 94 | 91 |
| | Residual Elongation (%) | 84 | 80 | 81 | 85 | 83 |
| | Weight Change Ratio (%) | 17 | 19 | 19 | 11 | 12 |
| | Volume Change Ratio (%) | 24 | 28 | 27 | 17 | 18 |
| CSA Cold Resistance | | Not passed | Passed | Not passed | Not passed | Passed |
| Oxygen Index | | 38 | 35 | 36 | 29.5 | 28 |
| Halogen Content (%) | | 9.1 | 9.2 | 12 | 0.3 | 0.2 |
| Flame Retardancy (M) | | 1.0 | 1.1 | 1.1 | 2.1 | 1.5 |

Referring to the Tables 3 and 4, it was revealed that the cable covering materials of Embodiments 1 to 6 according to the present invention have a halogen content of 5% or less, satisfy a CSA cold resistance at −40° C. and IEC 60332-3 Cat.A for flame retardancy, and also have an oxygen index of 30 or more and excellent physical properties such as oil resistance, room temperature properties, heat resistance and the like. On the while, it was revealed that the compositions are excellent in a flame retardancy, but a halogen content is increased to 5% or more and an oil resistance is deteriorated if only a conventional halogen-containing polymeric resin is used as the base resin, as described in the Comparative examples 1 to 3. It was also revealed that physical properties such as mechanical property and flame retardancy are deteriorated if a halogen content is lowered by use of the ethylene vinyl acetate copolymer as the base resin, as described in Comparative examples 4 and 5.

INDUSTRIAL APPLICABILITY

As described above, The composition for a cable covering material according to present invention and the ocean cable using the same have advantages that the composition has an excellent oil resistance to oil components without deteriorating mechanical properties, and has a superior durability such as a cold resistance at −40° C. as well as minimally generates toxic gases upon firing and has an excellent flame retardancy.

The invention claimed is:

1. A flame retardant composition for a cable covering material, comprising:

100 parts by weight of a base resin including 5~80 parts by weight of chloro-sulfonated polyethylene and 30~90 parts by weight of an ethylene/vinyl acetate copolymer having a vinyl acetate content of 28~80 % by weight;

30~150 parts by weight of metal oxide as a flame retardant;

1~30 parts by weight of a cold resistant plasticizer;

0.5~10 parts by weight of a silane coupling agent;

0.5~8 parts by weight of a co-crosslinking agent; and

3~20 parts by weight of a crosslinking agent.

2. The flame retardant composition for a cable covering material according to claim 1, wherein the base resin further includes 1 to 15 parts by weight of a modified ethylene/vinyl acetate copolymer which is grafted with polar groups and has a vinyl acetate content of 28 to 50 % by weight.

3. The flame retardant composition for a cable covering material according to claim 2, wherein a content of the polar groups is 0.5 to 2.0 % by weight, based on the total weight of the modified ethylene/vinyl acetate copolymer.

4. The flame retardant composition for a cable covering material according to claim 2, wherein the polar groups is one selected from the group consisting of maleic anhydride, glycidyl methacrylate and acrylic acid.

5. The flame retardant composition for a cable covering material according to claim 2, wherein the metal oxide is at least one selected from the group consisting of aluminum hydroxide, magnesium hydroxide, calcium hydroxide, basic magnesium carbonate, hydrotalcite, huntite and hydromagnesite.

6. The flame retardant composition for a cable covering material according to claim 2, wherein the cold resistant plasticizer is one selected from the group consisting of di-2-ethylhexyladipate, di-2-ethylhexylazelate, di-2-ethylhexylsebacate and diisodecyl adipate.

7. The flame retardant composition for a cable covering material according to claim 2, further comprising 2 to 30 parts by weight of a metal complex, based on 100 parts by weight of the base resin.

8. The flame retardant composition for a cable covering material according to claim 7, wherein the metal complex is at least one selected from the group consisting of antimony trioxide, molybdenum-phosphated zinc oxide, ammonium octa-molybdate, zinc -based molybdenum complex, zinc:calcium-based molybdenum complex, an inorganic additive in which magnesium oxide and silica are added to zinc-based molybdenum, an inorganic additive in which zinc oxide is mixed with phosphated zinc oxide, a boron compound and hydrotalcite.

9. The flame retardant composition for a cable covering material according to claim 1, wherein the metal oxide is at least one selected from the group consisting of aluminum hydroxide, magnesium hydroxide, calcium hydroxide, basic magnesium carbonate, hydrotalcite, huntite and hydromagnesite.

10. The flame retardant composition for a cable covering material according to claim 1, wherein the cold resistant plasticizer is one selected from the group consisting of di-2-ethylhexyladipate, di-2-ethylhexylazelate, di-2-ethylhexylsebacate and diisodecyl adipate.

11. The flame retardant composition for a cable covering material according to claim 1, further comprising 2 to 30 parts by weight of a metal complex, based on 100 parts by weight of the base resin.

12. The flame retardant composition for a cable covering material according to claim 11, wherein the metal complex is at least one selected from the group consisting of antimony trioxide, molybdenum-phosphated zinc oxide, ammonium octa-molybdate, zinc -based molybdenum complex, zinc:calcium-based molybdenum complex, an inorganic additive in which magnesium oxide and silica are added to zinc-based molybdenum, an inorganic additive in which zinc oxide is mixed with phosphated zinc oxide, a boron compound and hydrotalcite.

13. An ocean cable comprising a conductor; an insulating layer surrounding the conductor; a bedding layer surrounding the insulating layer; a braided layer surrounding the bedding layer; and a sheath layer surrounding the braided layer, wherein at least one of the bedding layer and the sheath layer comprises:

100 parts by weight of a base resin including 5~70 parts by weight of chloro-sulfonated polyethylene and 30~90 parts by weight of an ethylene/vinyl acetate copolymer having a vinyl acetate content of 28~80 % by weight;

30~150 parts by weight of metal oxide as a flame retardant;

1~30 parts by weight of a cold resistant plasticizer;

0.5~10 parts by weight of a silane coupling agent;

0.5~8 parts by weight of a co-crosslinking agent; and

3~20 parts by weight of a crosslinking agent.

14. The ocean cable according to claim 13, wherein the base resin further includes 1 to 15 parts by weight of a modified ethylene/vinyl acetate copolymer which is grafted with polar groups and has a vinyl acetate content of 28 to 50 % by weight.

15. The ocean cable according to claim 14, wherein a content of the polar groups is 0.5 to 2.0 % by weight, based on the total weight of the modified ethylene/vinyl acetate copolymer.

16. The ocean cable according to claim 14, wherein the polar groups is one selected from the group consisting of maleic anhydride, glycidyl methacrylate and acrylic acid.

17. The ocean cable according to claim 13, wherein the metal oxide is at least one selected from the group consisting of aluminum hydroxide, magnesium hydroxide, calcium hydroxide, basic magnesium carbonate, hydrotalcite, huntite and hydromagnesite.

18. The ocean cable according to claim 13, wherein the cold resistant plasticizer is one selected from the group consisting of di-2-ethylhexyladipate, di-2-ethylhexylazelate, di-2-ethylhexylsebacate and diisodecyl adipate.

* * * * *